United States Patent [19]

Shigaki

[11] Patent Number: 4,510,873

[45] Date of Patent: Apr. 16, 1985

[54] STOKER TYPE FIRING EQUIPMENT FOR USE WITH CITY REFUSE INCINERATOR

[75] Inventor: Masanobu Shigaki, Ibaraki, Japan

[73] Assignee: Kabushiki Kaisha Takuma, Osaka, Japan

[21] Appl. No.: 590,823

[22] Filed: Mar. 19, 1984

[30] Foreign Application Priority Data

Mar. 30, 1983 [JP] Japan ..... 58-56271

[51] Int. Cl.[3] ..... F23G 5/00; F22B 1/22

[52] U.S. Cl. ..... 110/289; 110/188; 110/282; 110/283; 110/302

[58] Field of Search ..... 110/278, 249, 281–283, 110/288, 291, 300, 289, 290, 255, 228; 122/1 A

[56] References Cited

U.S. PATENT DOCUMENTS

| | | | |
|---|---|---|---|
| 1,159,862 | 11/1915 | Ostergren | 110/291 |
| 1,397,642 | 11/1921 | Lundgren | 110/283 |
| 3,955,512 | 5/1976 | Martin | 110/255 |
| 3,985,084 | 10/1976 | Delaplace | 110/281 |
| 4,037,330 | 7/1977 | Kemmetmuller | 432/77 |
| 4,091,748 | 5/1978 | Mansfield | 110/228 |
| 4,170,183 | 10/1979 | Cross | 110/282 |
| 4,172,425 | 10/1979 | Sheridan | 110/257 |
| 4,250,820 | 2/1981 | Lautenschlager | 110/302 |
| 4,324,544 | 4/1982 | Blake | 110/245 |
| 4,411,204 | 10/1983 | Hamilton | 110/188 |

*Primary Examiner*—Henry C. Yuen

*Attorney, Agent, or Firm*—Griffin, Branigan & Butler

[57] ABSTRACT

Stoker type firing equipment for use with a city refuse incinerator provided with step type stokers formed by combining movable fire grates and fixed fire grates alternately and gas injectors installed in the fixed fire grates inject low temperature inert gas onto burning refuse, thus allowing free control of burning rate and burning temperature of the refuse by injecting the low temperature inert gas through the gas injectors.

1 Claim, 2 Drawing Figures

STOKER TYPE FIRING EQUIPMENT FOR USE WITH CITY REFUSE INCINERATOR

BACKGROUND OF THE INVENTION

The present invention relates to stoker type firing equipment for use with an incinerator for refuse (hereinafter called city refuse) coming out of households, plants, etc.

Conventionally, with a city refuse incinerator, a step type stoker, in which movable fire grates and fixed fire grates are combined alternately in a step like manner, allowing the movable fire grates to move back and forth against the fixed fire grates so that refuse is sent forward progressively, has been widely employed as firing equipment.

Stokers located at the upper, middle and lower parts of the aforementioned step type stoker are called respectively "dry stoker" for drying refuse, "combustion stoker" for combustion of the dried refuse, and "post-combustion stoker" for complete combustion of carbon left in combusted residuum, to turn it to ash.

First, city refuse is conveyed into an incinerator and passed onto the dry stoker, and its moisture is evaporated. Next, the dried refuse is passed onto the combustion stoker and combusted. Lastly, carbon found in residue is completely combusted on a post-combustion stoker, to turn it to ash, which is taken out of the incinerator.

A step type stoker for use with a conventional city refuse incinerator is so structured that its primary object is a complete and smooth combustion of city refuse, to turn it to ash with as little unburnt matter as possible.

Due to its structure, the free control of burning rate and burning temperature when burning city refuse is practically impossible using a step type stoker for use with a conventional city refuse incinerator. In reality, a precise control of burning rate and burning temperature when burning city refuse has very seldom been practiced.

On the other hand, due to remarkable recent improvement in living standards in Japan, the calories of refuse has almost reached a level of those of western countries. In Japan where the refuse contains a large amount of waste plastic material due to the extensive use of plastics, the calorific value is especially high.

It is found that a burning temperature reaches 1,200° C.–1,300° C. during the combustion, causing a state of excess burning.

Excess burning may cause damage to a fire grate of the stoker, and produce clinkers on the stoker, thus preventing continuous operation of the incinerator.

Furthermore, it may cause serious environmental pollution because $NO_x$ can easily be generated by a high burning temperature.

SUMMARY OF THE INVENTION

The present invention is a novel creation to solve the aforementioned problems related to a step type stoker for use with a conventional city refuse incinerator.

It is a first object of the present invention to provide stoker type firing equipment for use with an incinerator with which no damage is caused to a fire grate and no clinkers are produced while burning city refuse of high calorific value, thus allowing a long, continuous operation of the incinerator.

It is a second object of the present invention to provide stoker type firing equipment for use with an incinerator with which a large amount of $NO_x$ is not generated while burning city refuse of high calorific value, thus eliminating possible environmental pollution caused by generation of $NO_x$.

In accomplishing the aforementioned objectives, with stoker type firing equipment for use with a city refuse incinerator in the present invention, movable fire grates and fixed fire grates are combined alternately in a step like manner to form a step type stoker, and gas injectors are installed in the aforementioned fixed stokers to inject low temperature inert gas onto refuse burning on the stokers.

That is to say, burning rate and burning temperature of refuse are kept under control by means of injecting low temperature inert gas onto refuse burning on the stokers.

Commercially available low temperature gas can be used for this purpose. However, gas obtained after waste gas treatment from a dust collector installed on a city refuse incinerator can be utilized for this purpose because said gas becomes inert when its temperature is reduced to about 200° C.–250° C. This can be accomplished using heat exchange in the boiler in order to remove the heat of combustion from the gas.

As aforementioned, stoker type firing equipment in the present invention is so constructed that gas injectors are installed in fixed fire grates forming step type stokers, and low temperature inert gas is injected onto refuse, while burning, through said gas injectors, thus allowing a free control of burning rate and burning temperature.

Therefore, even when refuse of high calorific value is involved, fire grates in stokers are not damaged by heat, and clinkers are not produced on the stokers. At the same time, generation of $NO_x$ is prevented, thus ensuring the continuous operation of an incinerator without creating environmental pollution.

Furthermore, with the present invention, gas injectors are installed in the fixed fire grates, thus ensuring easy piping work for the low temperature inert gas, and also simplifying its structure. In addition, when gas obtained after waste gas treatment in a dust collector installed on a city refuse incinerator is utilized as the low temperature inert gas to be injected, the operation becomes remarkably economical since an outside source of gas is not required.

DETAILED DESCRIPTION OF THE DRAWINGS

Stoker type firing equipment for use with a city refuse incinerator according to the present invention will be hereafter explained in considering the drawings illustrating an embodiment.

Figure 1:
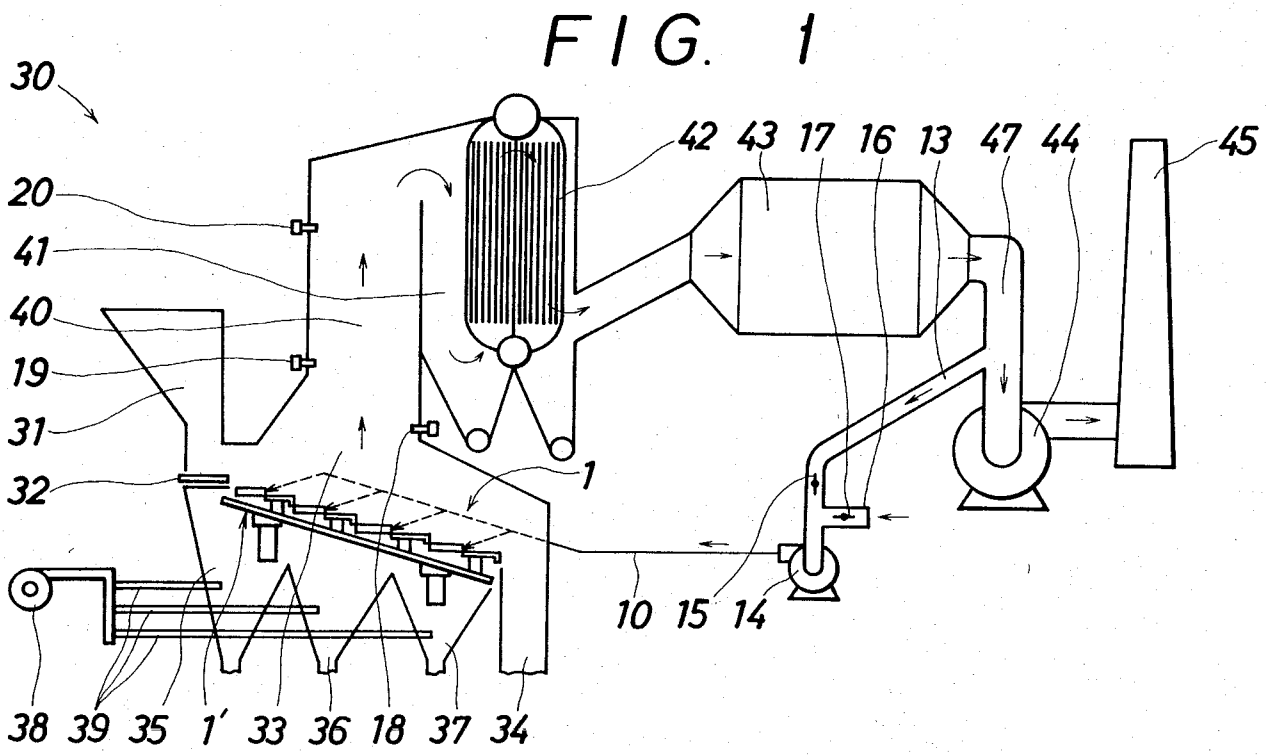
FIG. 1 is a schematic presentation illustrating an entire structure of a city refuse incinerator incorporating stoker type firing equipment with which the present invention is concerned.
Figure 2:
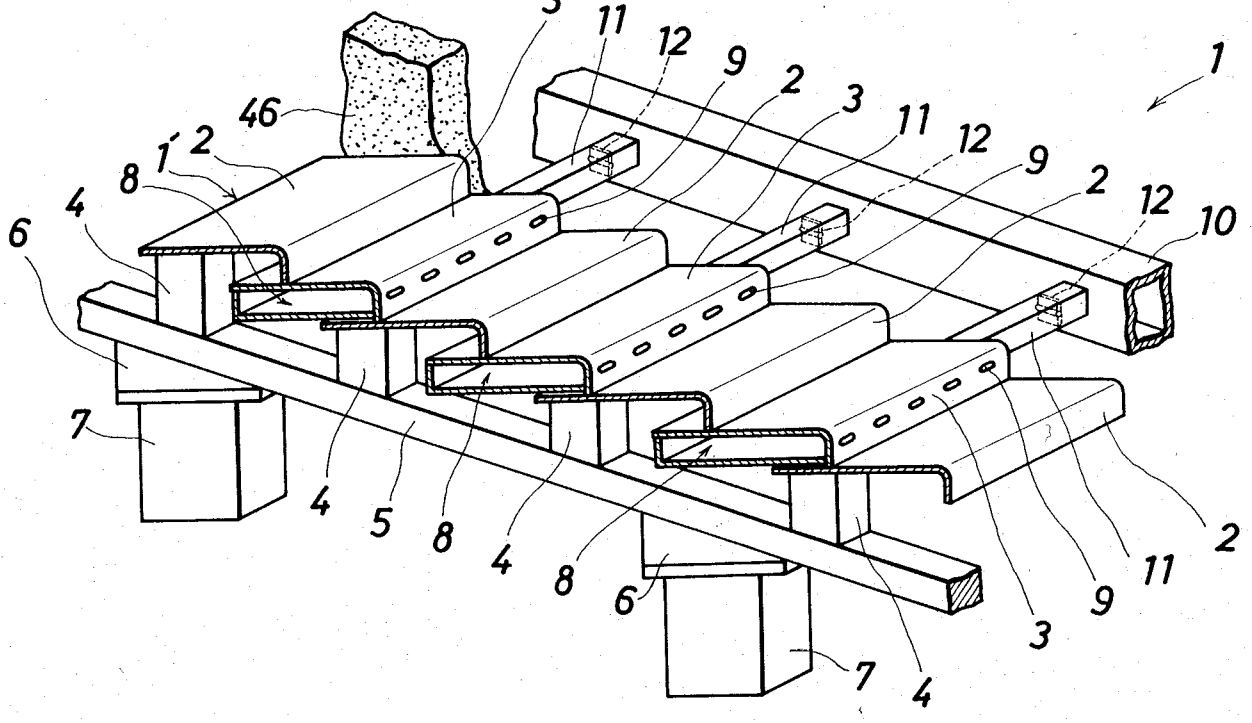
FIG. 2 is a perspective view illustrating the structure of a stoker type firing equipment which is one of the embodiments according to the present invention.

Referring to FIGS. 1 and 2, stoker type firing equipment 1 is applied to a city refuse incinerator 30.

The city refuse incinerator 30 is provided with a refuse feeding hopper 31, a refuse supply pusher 32, a furnace body 33, a discharge chute 34, hoppers 35, 36, 37, a forced draft fan 38, air ducts 39, combustion chambers 40, 41, a boiler 42, a dust collector (an electrostatic precipitator) 43, an induced draft fan 44, and a smoke stack 45.

A step type stoker 1' installed inside the furnace body 33 of a city refuse incinerator is equipped with movable fire grates 2 and fixed fire grates 3, both of which are alternatively combined in a step like manner.

Each movable fire grate 2 is fixed to a frame 5 with metal fittings 4, and stands 6 fitted to the front and rear parts of the frame 5 are mounted on a slider 7 fixed on the furnace body 33 so as to slide freely.

The aforementioned frame 5 is connected to an oil hydraulic driving mechanism (not illustrated), with which the frame 5 moves back and forth.

Each fixed fire grate 3 is fixed on a side wall 46 of the furnace body 33.

Furthermore, gas injectors 8 are installed in each fixed fire grate 3 to inject low temperature inert gas to refuse while burning.

With this example, the gas injectors 8 are constructed by forming a gas inlet opening (not illustrated) on a part of the box type fixed fire grate 3 and also making many gas injection holes 9 on a front wall of the fire grate 3.

In addition, the gas inlet openings of the gas injectors 8 are connected with a sub-duct 11 branched from a main duct 10 and penetrated through the side wall 46. A damper 12 is placed inside each sub-duct.

A passage 47 for communication between the dust collector 43 and the induced draft fan 44 is equipped with a branch pipe 13. Said branch pipe 13 and the main duct 10 are connected with a circulated draft fan 14.

A damper 15 is placed halfway along the branch pipe 13, and a little further away, an air induction pipe 16 is connected. Said air induction pipe 16 is also equipped with a damper 17.

Referring to FIG. 1, numerals 18, 19, and 20 designate air injection nozzles.

Next, the function under such a construction will be explained.

Refuse from the refuse feeding hopper 31 is sent forward to the stoker type firing equipment 1 by means of the refuse supply pusher 32.

With the step type stoker 1', movable fire grates move back and forth against the fixed fire grates 3 by means of an oil hydraulic driving mechanism, and refuse is, thus, shifted toward the discharge chute 34 progressively while it is combusted.

Air required for combustion is sent to hoppers 35, 36, 37 via the air ducts 39 by the forced draft fan 38. The air is then, supplied to refuse on stokers through a gap between movable fire grates 2 and fixed fire grates 3, thus resulting in the excellent combustion of refuse.

Combustion gas generated by combustion of refuse is released into the atmosphere through combustion chambers 40, 41, the boiler 42, the dust collector 43, the induced draft fan 44, and finally through the smoke stack 45.

On the other hand, gas purified through the dust collector becomes inert, having a temperature of approximately 200° C.-250° C. The low temperature inert gas is supplied to gas injectors 8 installed in fixed fire grates via the branch pipe 13, the circulated draft fan 14, the main duct 10 and sub-ducts 11, and injected onto refuse, while burning, through gas injection nozzles 9, thus making control of burning rate and burning temperature possible by action of sai low temperature inert gas.

Optimum combustion becomes possible by adjusting dampers 12 placed in each sub-duct 11, which make the quantity of low temperature inert gas to be supplied optimum corresponding to the zones on all stokers where refuse is being combusted.

In addition, the degree of inertia of low temperature inert gas is kept optimum by adjusting dampers 15, 17 placed in the branch pipe 13 and air induction pipe 16 respectively.

A suitable operation of each damper so as to inject low temperature inert gas under optimum conditions through gas injection holes on fixed fire grates can make a part of the refuse reduce without complete oxidization of refuse, thus preventing generation of $NO_x$ with reduced burning temperature.

Air injection nozzles 18, 19, 20 are for combustion of gas in turn by adding air to gas generated at the time when a part of refuse is combusted under reduction, thus allowing CO, $HN_3$, HCH, etc., in the generated gas to be thermally decomposed.

With this embodiment illustrated in FIG. 2, a fixed fire grate is formed in a box shape, in which the gas inlet opening and gas injection holes 9 are installed, to form the gas injector 8. However, the gas injector 8 is not limited to such a construction. For example, a gas injector 8 may be constructed so that a main pipe is placed on the reverse side of a fixed fire grate, many brach pipes may be branched from the main pipe, and tips of the branch pipe slightly projected from the front surface of a fixed fire grate.

The embodiments of the invention in which an exclusive property or privilege are claimed are defined as follows:

1. A stoker type firing apparatus for use with a city refuse incinerator comprising:

a step type stoker for receiving refuse to be incinerated, said stoker formed by combining movable fire grates which move back and forth and fixed fire grates, across which said refuse moves alternately in a step like manner, said movable fire grates sliding over said fixed fire grates to move said refuse thereacross;

gas injectors at said aforementioned fixed fire grates to inject low temperature inert gas onto refuse while burning on the stoker, said fixed grates having box shapes, being hollow, and being coupled to a source of low temperature inert gas, wherein said fixed grates have gas injection holes at front walls thereof so that the fixed fire grates receive inert gas which is injected from said gas injection holes so that they are utilized as said gas injectors;

a dust collector for receiving and treating combustion waste gas exhausted from a waste heat boiler of said incinerator to thereby purify said waste gas; and, a pipe system for channelling said purified waste gas to said hollow fixed grates so that it can be utilized as said low temperature inert gas.

* * * * *